US008109649B2

(12) United States Patent
Son et al.

(10) Patent No.: US 8,109,649 B2
(45) Date of Patent: Feb. 7, 2012

(54) CONVERSION TYPE LIGHT EMITTING DEVICE

(75) Inventors: Won Kuk Son, Ansan-si (KR); Yevgeni Aliyev, Ansan-si (KR)

(73) Assignee: Seoul Semiconductor Co., Ltd., Seoul (KR)

( * ) Notice: Subject to any disclaimer, the term of this patent is extended or adjusted under 35 U.S.C. 154(b) by 190 days.

(21) Appl. No.: 12/492,786

(22) Filed: Jun. 26, 2009

(65) Prior Publication Data

US 2009/0323306 A1 Dec. 31, 2009

(30) Foreign Application Priority Data

Jun. 27, 2008 (KR) ..... 10-2008-0062013

(51) Int. Cl.
*F21V 9/00* (2006.01)

(52) U.S. Cl. ..... 362/230; 362/512

(58) Field of Classification Search ..... 362/230, 362/512

See application file for complete search history.

(56) References Cited

U.S. PATENT DOCUMENTS

| | | | | |
|---|---|---|---|---|
| 6,036,328 | A * | 3/2000 | Ohtsuki et al. | 362/612 |
| 2003/0076281 | A1 * | 4/2003 | Morgan et al. | 345/44 |
| 2007/0019408 | A1 * | 1/2007 | McGuire et al. | 362/231 |
| 2007/0064409 | A1 * | 3/2007 | Hulse | 362/84 |
| 2007/0241653 | A1 * | 10/2007 | Chou | 313/111 |

FOREIGN PATENT DOCUMENTS

JP 2007-026749 2/2007

* cited by examiner

*Primary Examiner* — Julie Shallenberger

(74) *Attorney, Agent, or Firm* — H.C. Park & Associates, PLC

(57) ABSTRACT

A conversion type light emitting device includes at least one LED element having a predetermined light emitting range and a fluorescent element performing wavelength conversion of light emitted from the LED element when disposed at a first location in the predetermined light emitting range. The fluorescent element is movable from a first location to a second location outside the predetermined light emitting range.

19 Claims, 5 Drawing Sheets

(a)

(b)

(a)

(b)

CONVERSION TYPE LIGHT EMITTING DEVICE

CROSS REFERENCE TO RELATED APPLICATION

This application claims priority from and the benefit of Korean Patent Application No. 10-2008-0062013, filed on Jun. 27, 2008, which is hereby incorporated by reference for all purposes as if fully set forth herein.

BACKGROUND OF THE INVENTION

1. Field of the Invention

Exemplary embodiments of the present invention relate to light emitting diodes (LEDs) and, more particularly, to a conversion type light emitting device capable of converting light emitted from an LED into a different kind of light by a movable fluorescent element. More particularly, the present invention relates to a sterilization-lighting conversion type light emitting device that can selectively perform sterilization and lighting by converting ultraviolet light into visible light (particularly, white light), and vice versa.

2. Discussion of the Background

LEDs are a kind of semiconductor diode that emit light based on the principle energy is released in the form of light through recombination of electrons and holes when the diode is biased to allow a current to be injected into the diode in one direction. Generally, an LED element refers to an LED chip or LED package in which the LED chip is sealed in a package.

The LEDs emit light having a single peak wavelength, which is determined according to a semiconductor crystal material, kind, and concentration of impurities in a p-n junction, structure, and the like. The LEDs are classified into a blue LED, a green LED, a red LED, an ultraviolet (UV) LED, and the like according to peak wavelengths.

Since the LED emits monochromatic light, it is necessary to mix light having different peak wavelengths in order to obtain a desired color, such as, white light. To this end, a technique has been developed to mix light having different peak wavelengths emitted from different kinds of LEDs.

Further, a technique has been developed to emit a desired color through color mixture between non-wavelength-converted light and wavelength-converted light using phosphors converting the wavelength of light emitted from one LED. As well known in the art, for example, white light can be obtained by combination of a blue LED and green and red phosphors or combination of the blue LED and yellow phosphors. Further, white light can also be obtained by a combination of a UV LED and blue, green, and yellow phosphors or combination of the UV LED and blue and yellow phosphors.

Since such conventional techniques provides fixed light via combination of the LED and the phosphors, it is difficult to use characteristic light that is emitted from the LED and does not pass through the phosphors. Particularly, the UV LED emits UV light exhibiting excellent sterilization properties, but the combination of the UV LED and phosphors eliminates such sterilization properties. As a result, the application of the conventional techniques to systems, equipment or apparatuses demanding both a lighting function of visible light (particularly, white light) and a sterilization function is inefficient.

SUMMARY OF THE INVENTION

Exemplary embodiments of the present invention provide a conversion type light emitting device capable of converting light emitted from an LED into a different kind of light by a movable fluorescent element.

Exemplary embodiments of the present invention also provide a sterilizing-lighting conversion type light emitting device that can selectively perform sterilization and lighting by converting UV light into visible light (particularly, white light), and vice versa.

Additional features of the invention will be set forth in the description which follows, and in part will be apparent from the description, or may be learned by practice of the invention.

An exemplary embodiment of the present invention discloses a conversion type light emitting device having at least one light emitting diode (LED) element having a light emitting range; and a fluorescent element to convert a wavelength of light emitted from the LED element when disposed at a first location in the light emitting range, the fluorescent element being movable from the first location to a second location outside the light emitting range.

An exemplary embodiment of the present invention also discloses a conversion type light emitting device having a light emitting diode (LED) element; and a fluorescent element to convert a wavelength of light emitted from the LED element, the fluorescent element being movable with respect to the LED element.

An exemplary embodiment of the present invention also discloses a conversion type light emitting device having an ultraviolet (UV) light emitting diode (LED) element; and a fluorescent element being movable with respect to the UV LED element, wherein the fluorescent element comprises a phosphor to convert a wavelength of UV light into light having a different wavelength from that of the UV light.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
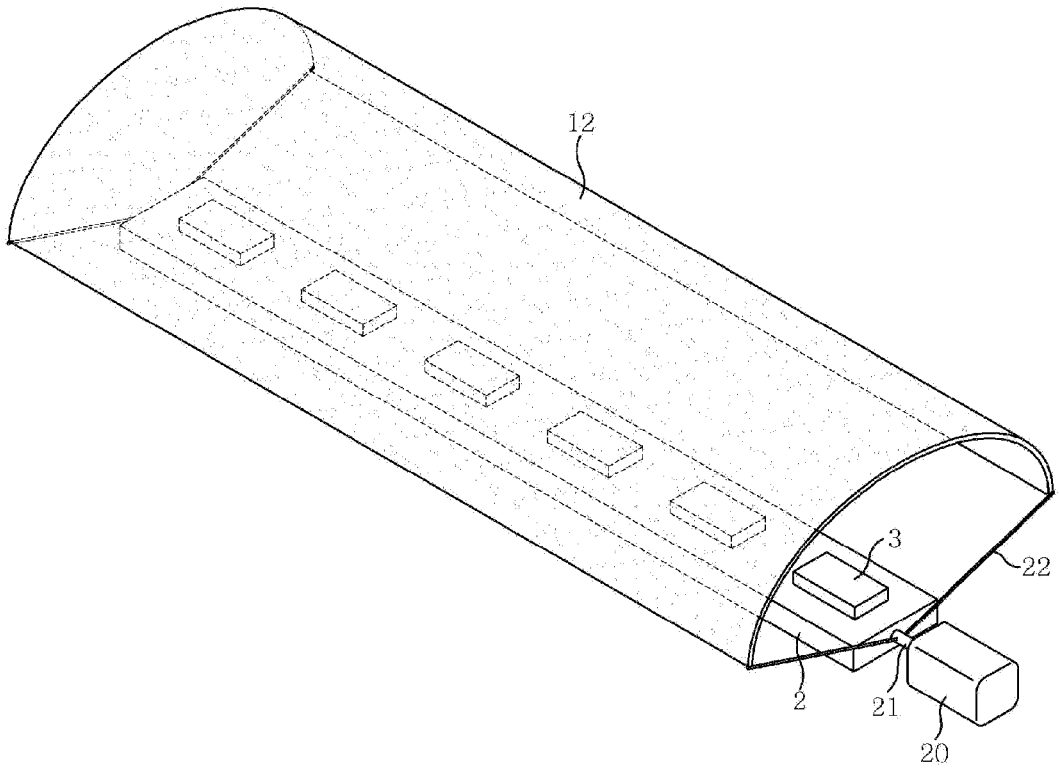
FIG. 1 is a schematic perspective view of a conversion type light emitting device according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

Figure 2:
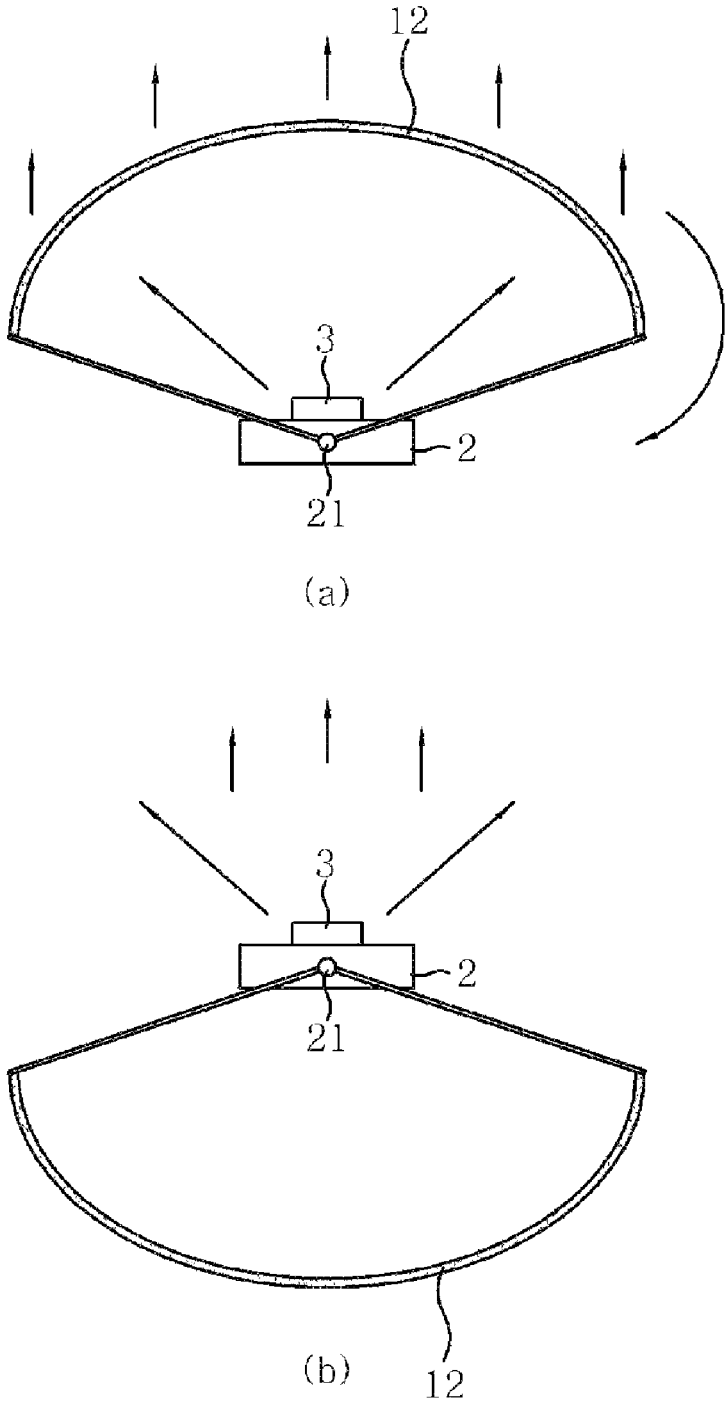
FIG. 2(*a*) and FIG. 2(*b*) are cross-sectional views of the light emitting device of FIG. 1.

FIG. 1 is a schematic perspective view of a conversion type light emitting device according to one exemplary embodiment of the invention, and FIG. 2(*a*) and FIG. 2(*b*) are cross-sectional views of the light emitting device of FIG. 1.

Referring to FIG. 1 and FIG. 2, the conversion type light emitting device according to this exemplary embodiment includes multiple LED elements 3 and a fluorescent element 12 that performs wavelength conversion of light emitted from the LED elements 3 into a different kind of light. The conversion type light emitting device may further include a shift mechanism 20 that shifts the fluorescent element 12 with respect to the multiple LED elements 3.

In this exemplary embodiment, the multiple LED elements 3 are UV LED elements that emit UV light having sterilization properties. Further, the multiple LED elements 3 are linearly mounted on an elongated printed circuit board (PCB) 2. Although the conversion type light emitting device of this embodiment includes multiple LED elements, the conversion type light emitting device may include a single LED element. Further, although the UV LEDs are used for conversion between sterilization and lighting in this embodiment, the light emitting device according to this disclosure may be utilized for applications demanding conversion of a certain light source into one or more other light sources.

In this exemplary embodiment, the fluorescent element 12 has an elongated transparent roof structure that has a substantially arc-shaped cross section and can entirely shield the front sides or light-emitting sides of the multiple LED elements 3 in a longitudinal direction.

The fluorescent element 12 may be formed by molding a resin mixed with phosphors into a roof shape or by coating phosphor particles on a roof-shaped glass or resin plate. Here, the fluorescent element is not limited to the shapes shown in FIG. 1 and FIG. 2, and may have various shapes.

In this embodiment, the fluorescent element 12 is pivoted on a shaft 21 by the shift mechanism 20. With this configuration, the fluorescent element 12 can be pivotally moved between a first location shown in FIG. 1 and FIG. 2(*a*) and a second location shown in FIG. 2(*b*).

At the first location, the fluorescent element 12 shields the front sides of the multiple LED elements 3, so that a considerable amount of UV light emitted from the multiple LED elements 3 is converted into, for example, white light by the fluorescent element 12. Here, the fluorescent element 12 contains two or more kinds of phosphors to convert the UV light into white light. For example, a combination of phosphors may comprise red, green, and blue phosphors. Alternatively, a combination of phosphors may comprise yellow and blue phosphors.

Conversely, as shown in FIG. 2(*b*), the fluorescent element 12 opens the front sides of the multiple LED elements 3 at the second location, so that the UV light emitted from the multiple LED elements 3 travels outside without passing through the fluorescent element 12.

Accordingly, the conversion type light emitting device can be switched from a white light emitting state to a UV light emitting state by the movement of the fluorescent element from the first location to the second location. When provided to any storage device, such as a refrigerator and the like, which is opened or closed by a door, the conversion type light emitting device emits white light or other colored visible light to perform a lighting function when the door of the storage device is opened. On the other hand, the light emitting device emits UV light sterilizing the interior of the storage device when the door is closed. Here, since opening and closing of the door can be detected by a sensor, the storage device may be provided with, for example, a controller for controlling the shift mechanism 20 in order to control the conversion operation of the conversion type light emitting device.

Figure 3:
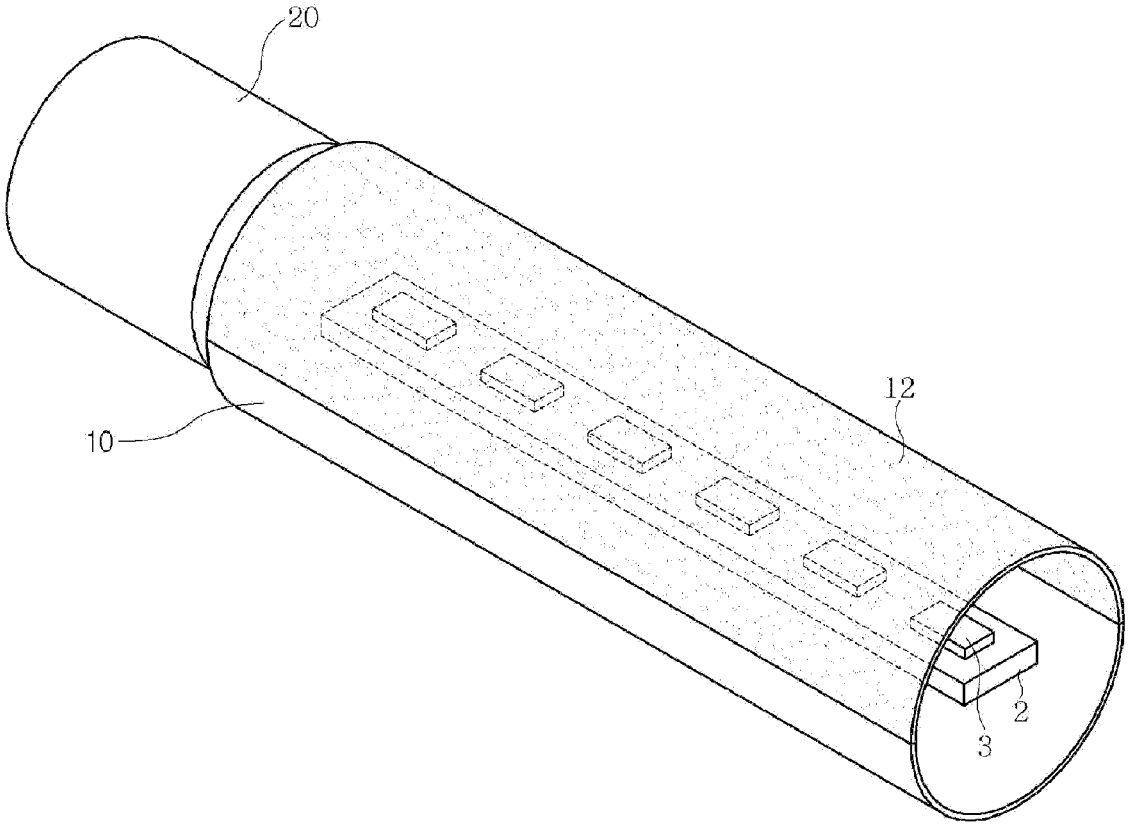
FIG. 3 is a schematic perspective view of a conversion type light emitting device according to another exemplary embodiment of the present invention.
Figure 4:
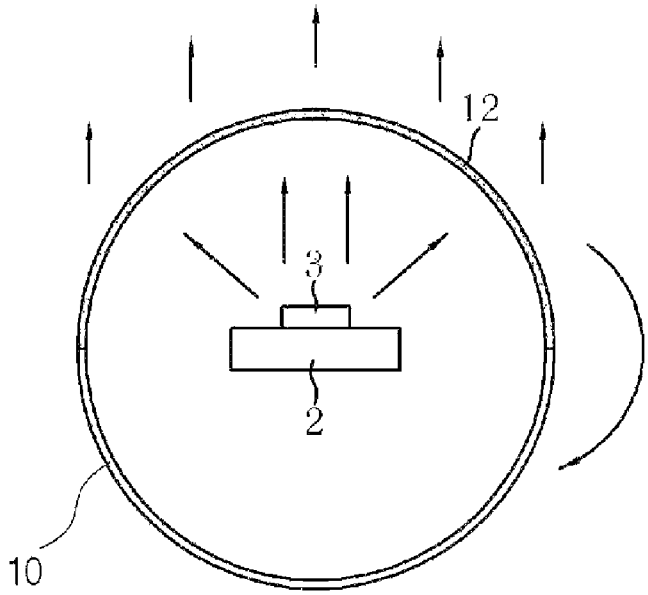
FIG. 4(*a*) and FIG. 4(*b*) are cross-sectional views of the light emitting device of FIG. 3.
Figure 4:
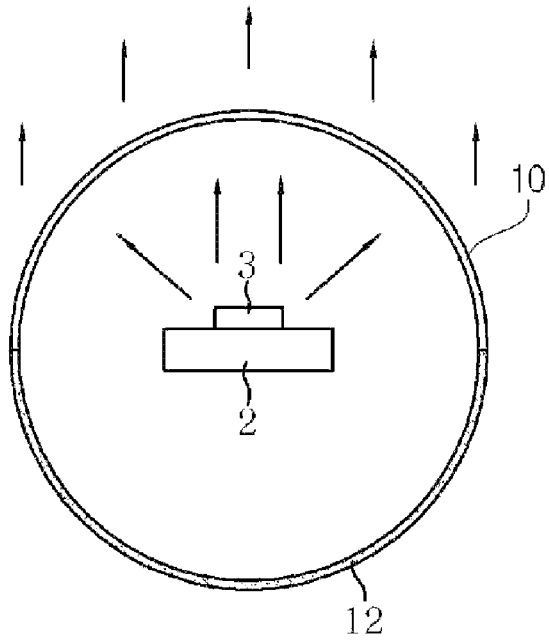

FIG. 3 is a schematic perspective view of a conversion type light emitting device according to another exemplary embodiment of the present invention, and FIG. 4(*a*) and FIG. 4(*b*) are cross-sectional views of the conversion type light emitting device of FIG. 3.

In FIG. 3 and FIG. 4, the conversion type light emitting device of this exemplary embodiment includes a rotatable transparent tube 10, such as a glass tube, a plastic tube, and the like, which surrounds the periphery of LED elements 3. The tube 10 is provided with a fluorescent element 12 in one circumferential region of the tube 10. The remaining circumferential region of the phosphor 10 is a transparent region, which does not contain fluorescent material. The fluorescent element 12 may be formed by inserting a fluorescent plate into an opening of the tube 10, which is formed in an outer circumferential region of the tube 10. Alternatively, the fluorescent element 12 may be formed by coating phosphors on an outer circumferential region of the tube 10 or by attaching a fluorescent film or other types of fluorescent elements to the outer circumferential region thereof.

The tube 10 is rotated about a shaft by a shift mechanism 20, so that the fluorescent element 12 can be rotated between a first location (see FIG. 3 and FIG. 4(*a*)) where the fluorescent element 12 shields the LED element 3 and a second location (see FIG. 4(*b*)) where the fluorescent element 12 does not shield the LED element 3. When the fluorescent element 12 is located at the first location, light emitted from the LED elements 3 is converted into a different kind of light by the fluorescent element 12, and, when the fluorescent element 12 is located at the second location, the light emitted from the LED elements 3 is directed to the outside through the transparent region of the tube 10 where the fluorescent element 12 is not provided.

Figure 5:
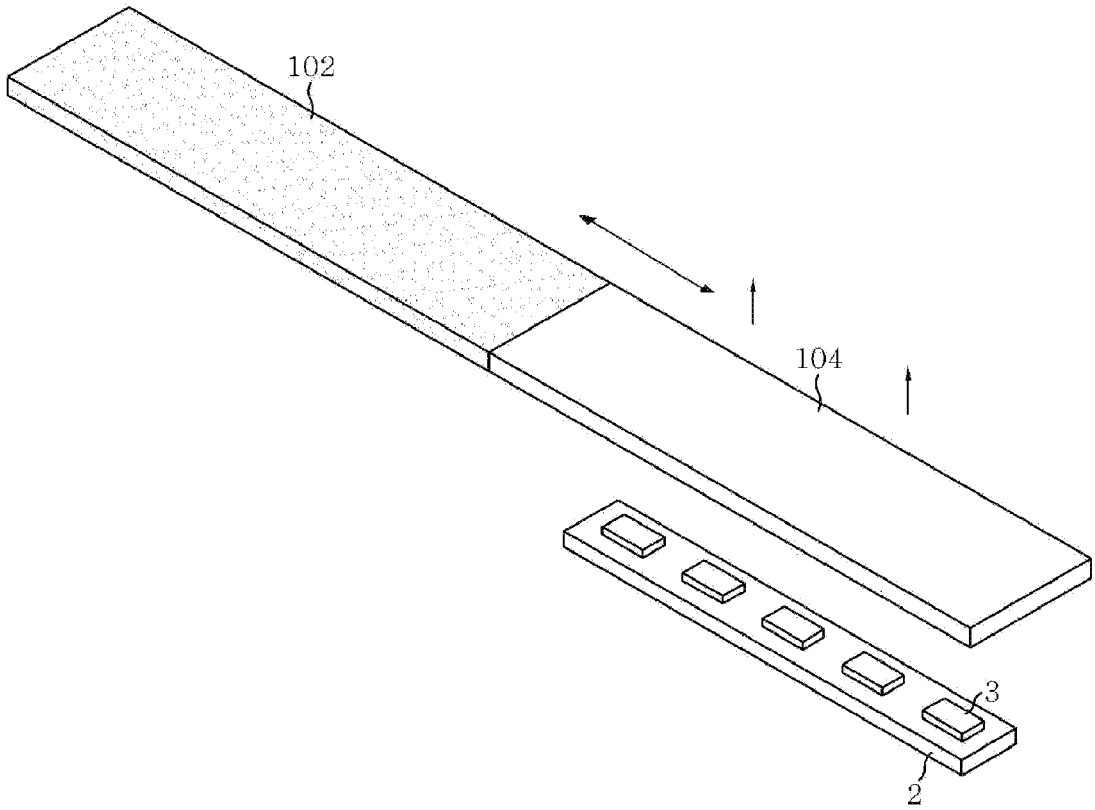
FIG. 5 is a perspective view of a conversion type light emitting device according to a further exemplary embodiment of the present invention.

FIG. 5 is a schematic perspective view of a conversion type light emitting device according to a further exemplary embodiment of the invention.

Referring to FIG. 5, multiple LED elements 3 are arranged on an elongated PCB 2 in the longitudinal direction. Further, an elongated transparent planar member is disposed above the LED elements 3 to move in a linear direction. The transparent member includes a fluorescent element 102 and a non-fluorescent element 104 that are adjacent to each other in the longitudinal direction. The transparent member may be moved in the linear direction between a first location, where the fluorescent element 102 shields the LED elements 3, and a second location, where the non-florescent element 104 shields the LED elements 3.

As in the above exemplary embodiments, at the first location, some of the light, for example, UV light, emitted from the LED elements 3 is subjected to wavelength conversion into a different kind of light, for example, white light, by the fluorescent element 102. On the contrary, at the second location, the light, for example, UV light, emitted from the LED elements 3 is directed to the outside through a transparent or semi-transparent region of the transparent member without the wavelength conversion.

Although not shown in the drawings, a roof-shaped belt may be prepared as the transparent member including the fluorescent element 102 and driven by a pulley connected to the shift mechanism such that the fluorescent element can be shifted with respect to the LED elements.

As apparent from the description, according to one exemplary embodiment of the invention, the light emitting device is configured to selectively use a movable fluorescent element to allow the use of both the characteristic light emitted from an LED element and the light passing through the fluorescent element, thereby providing good efficiency. Here, the light emitting device may employ various fluorescent elements, thereby providing various light sources.

Further, according to one exemplary embodiment of the invention, the light emitting device allows UV light emitted from a UV LED element to be used as a light source for sterilization, and allows visible light, particularly, white light, obtained by combination of the UV light and a fluorescent element to be used as a light source for lighting. For example, when an interior of a certain device, for example, a refrigerator, is exposed to a person (opened), the light emitting device is used as the light source for lighting, and when the interior of the device is not exposed to a person (closed), the light emitting device is used as the light source for sterilizing the interior of the device.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A conversion type light emitting device, comprising:

at least one light emitting diode (LED) element to emit light in a light emitting direction; and a fluorescent element to convert a wavelength of the light emitted from the LED element, wherein the fluorescent element comprises a transparent fluorescent plate configured to be disposed at a first location where the transparent fluorescent plate wavelength-converts the light emitted from the LED element and to be disposed at a second location where the light emitted from the LED element is not wavelength converted, and wherein the at least one LED element is mounted on a support element, and the fluorescent plate is pivotally connected to a first end and a second end of the support element by connecting elements.

2. The conversion type light emitting device of claim 1, wherein the transparent fluorescent plate is configured to wavelength-convert a light emitting side of the LED element at the first location and to expose the light emitting side of the LED element at the second location.

3. The conversion type light emitting device of claim 1, wherein the fluorescent element is disposed on a region of a rotatable transparent member surrounding the LED element.

4. The conversion type light emitting device of claim 3, wherein the rotatable transparent member comprises an elongated tube made of a transparent material and surrounds two or more linearly arranged LED elements.

5. The conversion type light emitting device of claim 1, wherein the fluorescent element is disposed on a longitudinal region of an elongated transparent member.

6. The conversion type light emitting device of claim 5, wherein the elongated transparent member is movable in a linear direction.

7. The conversion type light emitting device of claim 1, wherein the LED element comprises an ultraviolet (UV) LED element and the fluorescent element comprises a phosphor to convert a wavelength of UV light into light having a different wavelength from that of the UV light.

8. The conversion type light emitting device of claim 7, wherein the phosphor comprises a combination of red, green, and blue phosphors.

9. The conversion type light emitting device of claim 7, wherein the phosphor comprises a combination of blue and yellow phosphors.

10. The conversion type light emitting device of claim 1, further comprising:

a shifting member to move the fluorescent element or a member on which the fluorescent element is mounted.

11. A conversion type light emitting device, comprising:

a light emitting diode (LED) element; and a fluorescent element to convert a wavelength of light emitted from the LED element, wherein the fluorescent element is configured to move with respect to the LED element and comprises a transparent fluorescent plate to be disposed at a first position where the transparent fluorescent plate wavelength-converts the light emitted from the LED element and at a second position where the light emitted from the LED element is not wavelength converted, and wherein the LED element is mounted on a support element, and the fluorescent plate is pivotally connected to a first end and a second end of the support element by connecting elements.

12. The conversion type light emitting device of claim 11, wherein the transparent fluorescent plate is configured to wavelength-convert a light emitting side of the LED element at the first position and to expose the light emitting side of the LED element at the second position.

13. The conversion type light emitting device of claim 11, wherein the fluorescent element is disposed on a region of a rotatable transparent member surrounding the LED element.

14. The conversion type light emitting device of claim 13, wherein the rotatable transparent member comprises an elongated tube made of a transparent material and surrounds two or more linearly arranged LED elements.

15. The conversion type light emitting device of claim 11, wherein the fluorescent element is disposed on a longitudinal region of an elongated transparent member movable in a linear direction.

16. The conversion type light emitting device of claim 11, wherein the LED element comprises an ultraviolet (UV) LED element and the fluorescent element comprises a phosphor to convert a wavelength of UV light into light having a different wavelength from that of the UV light.

17. The conversion type light emitting device of claim 16, wherein the phosphor comprises a combination of red, green, and blue phosphors.

18. The conversion type light emitting device of claim 16, wherein the phosphor comprises a combination of blue and yellow phosphors.

19. A conversion type light emitting device, comprising:

an ultraviolet (UV) light emitting diode (LED) element to emit light in a light emitting direction; and a fluorescent element comprising a phosphor to convert a wavelength of UV light into light having a different wavelength from that of the UV light, wherein the fluorescent element comprises a transparent fluorescent plate configured to be disposed at a first position where the transparent fluorescent plate wavelength-converts the light emitted from the UV LED element in the light emitting direction and to be disposed at a second position where the light emitted from the UV LED element in the light emitting direction is not wavelength converted, and wherein the UV LED element is mounted on a support element, and the transparent fluorescent plate is pivotally connected to a first end and a second end of the support element by connecting elements.

* * * * *